United States Patent [19]

Karst et al.

[11] Patent Number: 4,857,119

[45] Date of Patent: Aug. 15, 1989

[54] CASE-HARDENED PLATE ARMOR AND METHOD OF MAKING

[75] Inventors: David A. Karst, Kincheloe; Felix R. Pawlowski, Warren; William A. Potrafke, Rochester; Harold E. Schuneman, North Street, all of Mich.

[73] Assignee: General Dynamics Lands Systems, Inc., Sterling Heights, Mich.

[21] Appl. No.: 162,558

[22] Filed: Mar. 1, 1988

[51] Int. Cl.[4] ..... C21D 9/42

[52] U.S. Cl. ..... 148/318; 89/36.02; 109/78; 148/16.5; 148/16.6; 148/125; 148/902; 428/596; 428/610

[58] Field of Search ..... 148/16.5, 16.6, 318, 148/125, 902; 428/596, 597, 610; 89/36.02; 109/78, 83, 84, 85

[56] References Cited

U.S. PATENT DOCUMENTS

| | | | |
|---|---|---|---|
| 45,536 | 12/1864 | Terwilliger et al. | 428/597 |
| 774,959 | 11/1904 | Tresidder | 89/36.02 |
| 874,729 | 12/1907 | DeBobula | 109/83 |
| 1,043,416 | 11/1912 | Giolitti | 148/319 |
| 1,079,323 | 11/1913 | Benthall | 148/12.1 |
| 1,097,573 | 5/1914 | Wales | 148/320 |
| 1,548,441 | 8/1925 | Branovich | 89/36.02 |
| 1,563,420 | 12/1925 | Johnson et al. | 148/12.1 |
| 1,995,484 | 3/1935 | Sullivan | 148/318 |
| 2,348,130 | 5/1944 | Hardy, Jr. | 89/36.02 |
| 2,733,177 | 1/1956 | Meyer | 428/597 |
| 3,736,838 | 6/1973 | Butterweck et al. | 89/36.02 |
| 4,178,859 | 12/1979 | Seiz et al. | 109/83 |
| 4,455,801 | 6/1984 | Merritt | 109/84 |

FOREIGN PATENT DOCUMENTS

| | | | |
|---|---|---|---|
| 63314 | 4/1985 | Japan | 148/16.5 |
| 206616 | 6/1968 | U.S.S.R. | 148/16.6 |
| 1046320 | 10/1983 | U.S.S.R. | 148/318 |

*Primary Examiner*—Robert McDowell
*Attorney, Agent, or Firm*—Brooks & Kushman

[57] ABSTRACT

Case-hardened plate armor disclosed includes a steel plate (14,18) that is heat treated to provide carbonitride surfaces and a tough, ductile core, with the carbonitride surfaces having a toughness of at least 66, and preferably at least 67, on the Rockwell C scale to prevent surface penetration, and with the tough, ductile core being softer than the carbonitride surfaces to prevent brittle fracture. The steel plate (14,18) may be made from either rolled homogenous armor which has a final core hardness in the range of 45 to 50 on the Rockwell C scale, or from high-hard armor which has a final core hardness in the range of 52 to 54 on the Rockwell C scale. The steel plate may be made with holes or may be imperforate depending upon weight requirements. The case-hardening of the steel plate is performed by heating in an atmosphere of nitrogen and carbon, quenching of the heated steel plate, thereafter tempering the quenched steel plate, deep freezing of the tempered steel plate, and subsequently again tempering the steel plate after the deep freezing to provide the hard carbonitride surfaces and the softer but tougher and more ductile core.

12 Claims, 4 Drawing Sheets

CASE-HARDENED PLATE ARMOR AND METHOD OF MAKING

TECHNICAL FIELD

This invention relates to steel plate armor for protecting objects such as vehicles from incoming objects or from other types of attack that can cause damage and also relates to a method for making the plate armor.

BACKGROUND ART

Armor plate of hardened steel has been used for many years to provide protection of objects against damage. Vehicles such as tanks, military sites, vaults, and safes, etc. have used steel armor plate to provide such protection.

In order to increase the protection provided, it has previously been proposed to use spaced layers of steel. For example, U.S. Pat. No. 1,548,441 Branovich discloses an armor protected fuel tank wherein a layer of wood and a layer of semi-cured rubber are positioned between a steel tank and an outer armor plate. U.S. Pat. No. 2,348,130 of Hardy, Jr. discloses spaced metal plates between which a layer of rubber is positioned with pockets in the rubber filled with abrasive material such as sand. U.S. Pat. No. 2,733,177 Meyer discloses an elastic cascading impact absorber wherein layers of armor are spaced with respect to each other by elastic material which is disclosed in preferred embodiment as being formed sheet metal springs. U.S. Pat. No. 4,455,801 Merritt discloses a lightweight vault wall wherein layers of metal, stainless steel and aluminum, cover spaced layers of plywood adjacent each of which is provided a layer of expanded metal mesh that is spaced from the other layer of expanded metal mesh by a foamed plastic core.

Two different basic types of armor plate are conventionally utilized at the present time. One type is high-hard armor that is extremely hard and thus capable of preventing penetration of penetrating type of projectiles. The other type is rolled homogeneous armor that is somewhat softer than high-hard armor but is more ductile so as to prevent brittle fracture. Prior art references which disclose compositions and processing used in hardening of steel plates include: U.S. Pat. Nos. 774,959 Tresidder; 1,043,416 Giolitti; 1,079,323 Benthall; 1,097,573 Wales; 1,563,420 Johnson et al; and 1,995,484 Sullivan as well as the previously mentioned U.S. Pat. No. 2,733,177 Meyer.

In order to decrease weight, armor plate and the like have previously included holes such as illustrated by U.S. Pat. No. 3,763,838 of Butterweck et al which discloses a protective shielding for vehicles. While circular holes such as disclosed by Butterweck et al or slots are the easiest to produce in armor by punching, such shapes have ballistic gaps that reduce the protection provided. Similarly, square holes which will provide the lowest weight also have ballistic gaps that reduce the protection provided.

Other prior art references disclosing armor plate or the like include U.S. Pat. Nos. 45,536 Terwilliger et al; 874,729 DeBolula; and 4,178,859 Seiz et al.

DISCLOSURE OF INVENTION

An object of the present invention is to provide improved case-hardened plate armor and a method for heat treating steel plates to provide the armor.

The improved case-hardened plate armor according to the invention includes a steel plate that is heat treated to provide carbonitride surfaces and a tough, ductile core. The carbonitride surfaces of the steel plate have a hardness of at least 66 on the Rockwell C scale to prevent surface penetration, and the tough, ductile core is softer than the carbonitride surfaces to prevent brittle fracture of the steel plate. While the hardness of 66 on the Rockwell C scale of the carbonitride surfaces is adequate, it is preferable for the carbonitride surfaces to have a surface hardness of at least 67 on the Rockwell C scale to provide greater resistance to surface penetration.

Either rolled homogenous armor or high-hard armor may be utilized to provide the case-hardened plate armor with carbonitride surfaces. When rolled homogenous armor is utilized, the core hardness is in the range of 45 to 50 on the Rockwell C scale. When high-hard armor is utilized, the core hardness is in the range of 52 to 54 on the Rockwell C scale. In either case, the steel plate preferably has a thickness in the range of about 0.15 to 0.5 of an inch.

The plate armor with the carbonitride surfaces may be initially formed with holes prior to the heat treating in order to effect weight savings. However, it is also possible to utilize the carbonitrided steel plate without any holes if the weight savings is not necessary. When the holes are utilized, it is preferable to have the holes provided with the same size and shape as each other arranged in a repeating pattern. Most preferably, webs between the holes have a width in the range of 0.1 to 0.25 of an inch to provide best results in the provision of surface hardness and core toughness.

The method for case-hardening of the steel plate to provide the plate armor includes heating of the steel plate in an atmosphere of nitrogen and carbon, subsequently quenching the heated steel plate, tempering the quenched steel plate, deep freezing the tempered steel plate, and subsequently again tempering the steel plate after the deep freezing to provide hard carbonitride surfaces and a softer but tougher and more ductile core.

The steel plate is disclosed as being heated in an atmosphere of cracked ammonia and methane to provide the nitrogen and carbon, and such heating is preferbly performed for 1 to 3 hours at a temperature in the range of 1300° F. to 1550° F.. After such heating, the quenching is preferably performed by an oil quench to insure that all austensite is changed to martensite and to also prevent distortion as the quenching takes place.

The initial tempering of the quenched steel plate is performed for ½ to 2 hours at a temperature in the range of 275° F. to 325° F. This tempering changes the martensite to tempered martensite and ferrite.

An air cooling is preferably utilized after the initial tempering to eliminate the expenditure of unnecessary energy in effecting the deep freeze step. This deep freezing is preferably performed for 1 to 3 hours at a temperature in the range of −50° F. to −150° F. to change any retained austensite to martensite.

The final tempering after the deep freeze is preferably performed for ½ to 2 hours at a temperature in the range of 275° F. to 325° F., which are the same time and temperature parameters as the initial tempering. This subsequent tempering changes any additional martensite resulting from the deep freeze step to tempered martensite and ferrite.

Any holes in the steel plate are formed prior to the initial heating in the atmosphere of nitrogen and carbon to facilitate the hole formation in the steel prior to its hardening.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
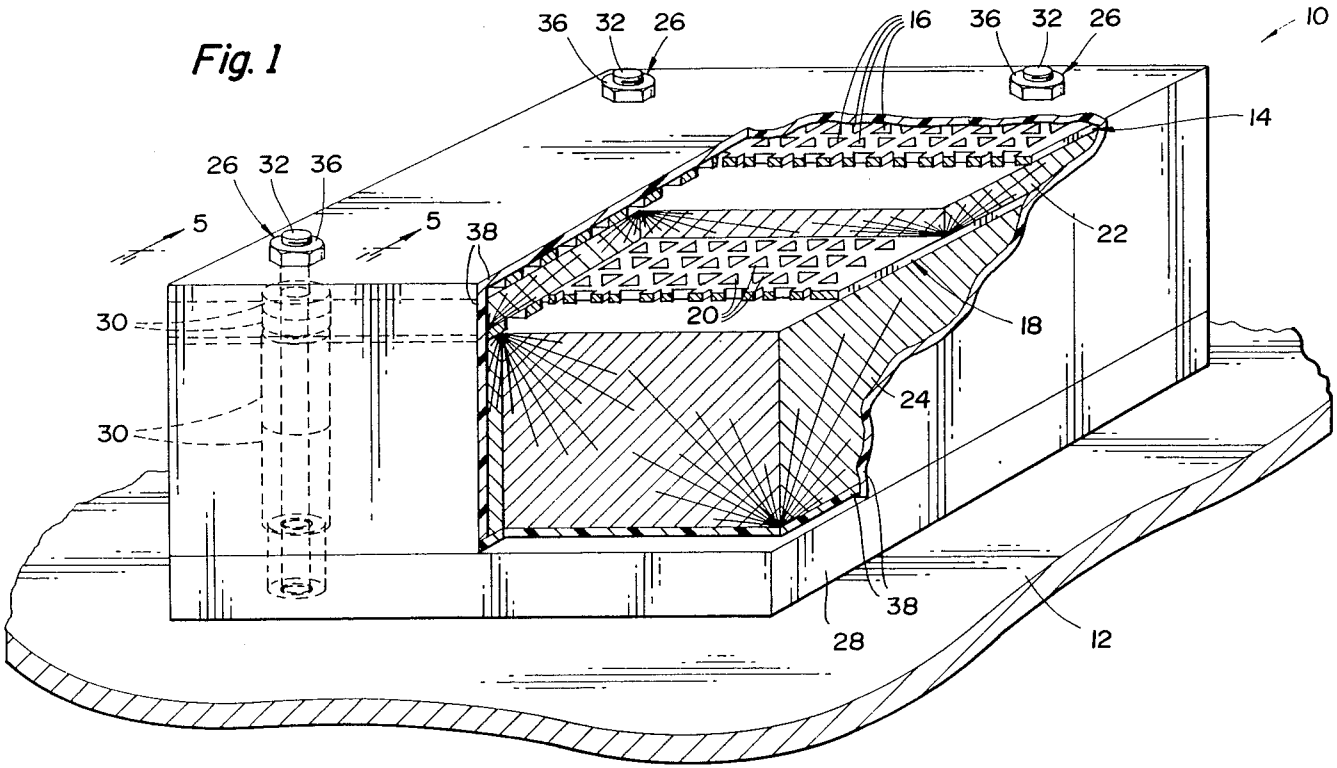
FIG. 1 is a perspective view that is partially broken away in section to illustrate an armor plate module having steel plates that embody and are heat treated in accordance with the method of the present invention.
Figure 4:
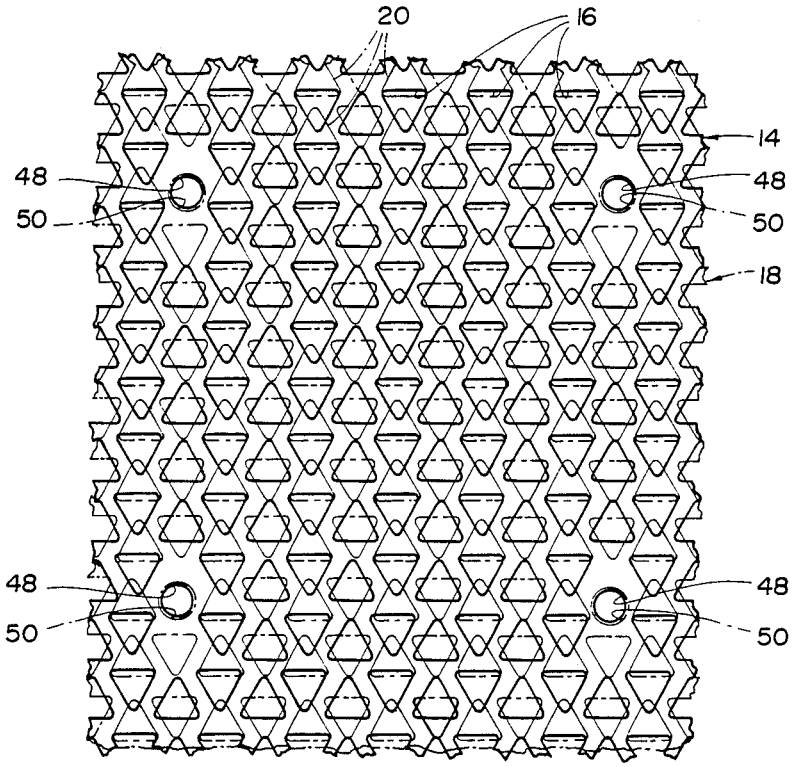
FIG. 4 is a plan view that illustrates an offset relationship of the hole patterns of the outer and inner steel plates of the armor plate module when mounted with respect to each other as illustrated in FIG. 1.

With reference to FIG. 1 of the drawings, an armor plate module generally indicated by 10 embodies and is made by the heat treat method of the present invention as is hereinafter more fully described to provide protection for an object 12 such as the outer skin of a vehicle. The armor plate module 10 is disclosed as including an assembly of perforated plate armor having an outer perforated steel plate 14 with a pattern of spaced holes 16. Armor plate module 10 as disclosed also includes an inner perforated steel plate 18 having a pattern of spaced holes 20. As is hereinafter more fully described, each of the outer and inner steel plates 14 and 18 is heat treated in accordance with the heat treat method of the present invention to have hardened surfaces and a more ductile core. A pair of fillers 22 and 24 and connectors 26 provide a means for supporting the outer and inner perforated steel plates 14 and 18 in a spaced relationship to each other at outer and inner locations with respect to the object 12 to be protected. In this assembled condition, the pattern of holes 16 of the outer steel plate 14 and the pattern of holes 20 of the inner steel plate 18 are offset with respect to each other as illustrated in FIG. 4 to thereby cooperate in preventing a projectile from penetrating straight through both plates.

Figure 5:
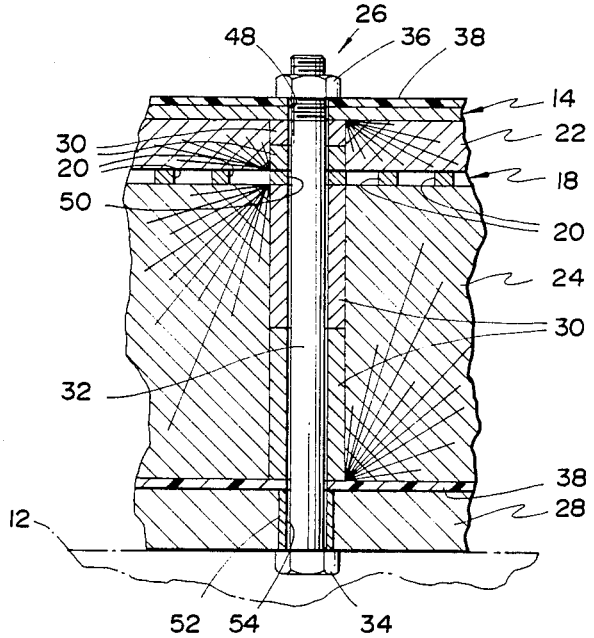
FIG. 5 is a sectional view taken along the direction of line 5—5 in FIG. 1 to illustrate the construction of connectors that connect the outer and inner steel plates to each other in a spaced relationship.

As shown in both FIGS. 1 and 5, the perforated plate armor provided by the module 10 also includes an inner backing plate 28 for stopping any particles that might pass through both perforated steel plates 14 and 18. This inner backing plate 28 is most preferbly made from aluminum when taking into consideration both weight and strength factors.

The one filler 22 is located between the outer and inner perforated steel plates 14 and 18 to fill the spacing between these two plates, while the other filler 24 is located between the inner perforated steel plate 18 and the aluminum backing plate 28 to likewise fill the spacing between these two plates. Both of the fillers 22 and 24 can be made from any suitble material that is lightweight while still having the requisite strength such as foam, plastic, or a lightweight wood like balsa wood.

With combined reference to FIGS. 1 and 5, the connectors 26 include spacers 30 that space the outer and inner perforated steel plates 14 and 18 with respect to each other. As illustrated, each connector 26 includes a pair of the spacers 30 that space the outer and inner steel plates 14 and 18 with respect to each other and also includes a pair of spacers 30 tht space the inner steel plate 18 with respect to the backing plate 28. It is also possible to utilize a single spacer for separating each of the adjacent pairs of plates; however, use of multiple spacers provides ease of adjustment of the plate spacing by merely adding or removing one or more spacers sized to provide best results. The spacers 30 have annular shapes through which a bolt 32 of the associated connector 26 extends between the outer and inner perforated steel plates 14 and 18 and the aluminum backing plate 28. A head 34 of bolt 32 is engaged with the backing plate 28 as illustrated, while a nut 36 threaded onto the bolt 32 holes the outer steel plate 14 as shown in FIG. 5.

With reference to FIG. 1, the armor plate module 10 also includes an integument 38 in which the outer and inner perforated steel plates 14 and 18 are enclosed along with the first and second fillers 22 and 24. This integument 38 preferably includes a fiberglass mat covered by a veil cloth and functions to encase the outer and inner perforated steel plates 14 and 18 and the first and second fillers 22 and 24 as a module in association with the connectors 26 that also secure the backing plate 28.

Figure 2:
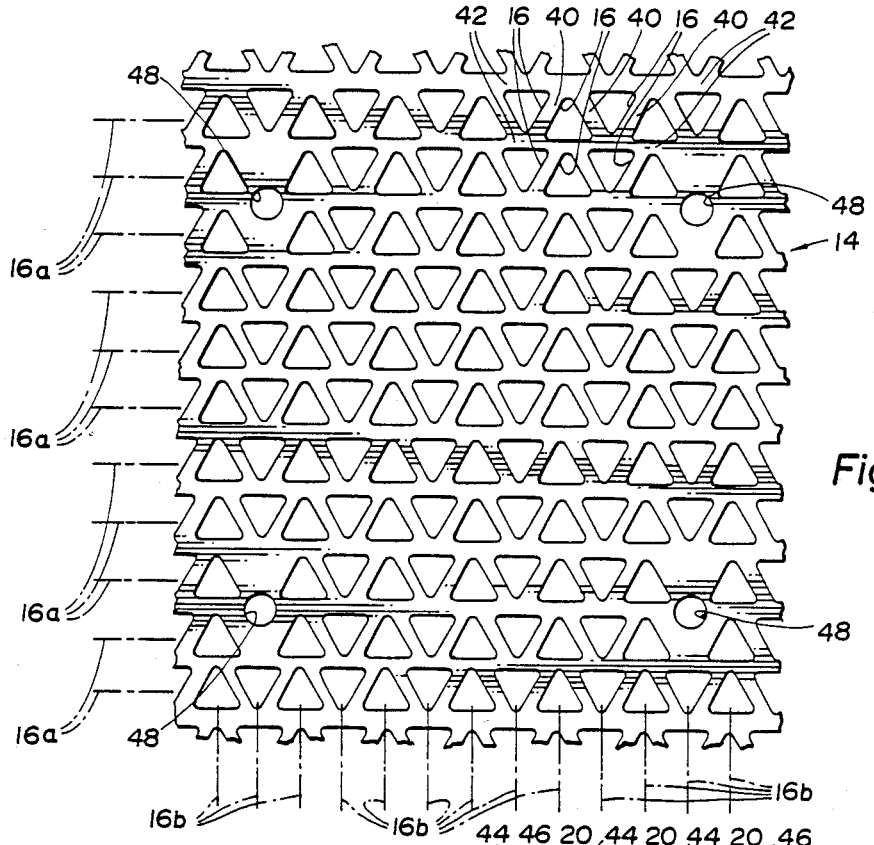
FIG. 2 is a plan view that illustrates a hole pattern of an outer steel plate of the armor plate module.
Figure 3:
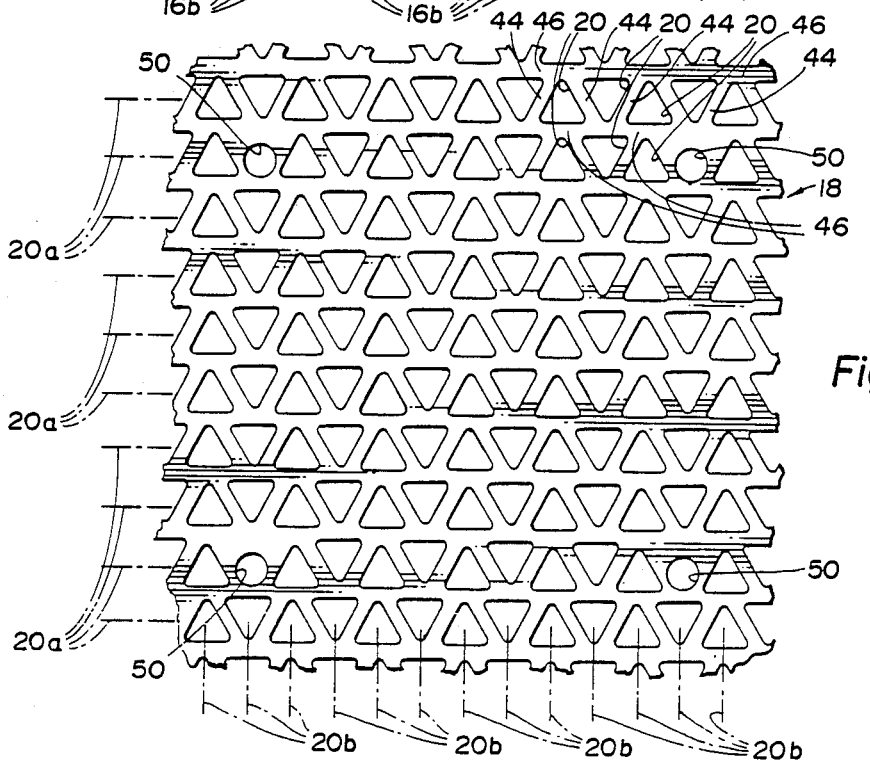
FIG. 3 is a plan view that illustrates a hole pattern of an inner steel plate of the armor plate module.

As illustrated in FIGS. 2 and 3, each of the hardened steel plates 14 and 18 has its associated holes 16 and 20 provided with triangular shapes that are arranged in a repeating pattern. Specifically, the triangular holes 16 of the outer perforated steel plate 14 shown in FIG. 2 are arranged in rows 16*a* and columns 16*b*. Webs 40 of the plate 14 separate the triangular holes 16 along each row 16*a*, while webs 42 separate the triangular holes 16 along each column 16*b*. Likewise, the inner steel plate 18 shown in FIG. 3 has its triangular holes 20 arranged in rows 20*a* and columns 20*b* in the same manner with webs 44 spacing the triangular holes 20 along each column 20*a* and with webs 46 spacing the triangular holes 20 along each column 20*b*. This construction of each steel plate 14 and 18 provides lightweight armor plate without ballistic gaps that would occur with other shapes such as round or slotted holes that are easier to form by a punchign operation or with square holes that provide the most lightweight construction possible.

As shown in both FIGS. 2 and 3, the triangular holes 16 and 20 of each of the steel plates 14 and 18 are shaped and positioned with respect to each other such that the associated webs 40,42 and 44,46 are generally straight. The triangular holes 16 and 20 of each steel plate preferably have the same size and shape as each other and are most preferably constructed as equilateral triangles. Adjacent triangular holes 16 and 20 with the equilateral shapes along the rows 16*a* and 20*a* are rotated at 120° with respect to each other to provide the generally straight webs 40 and 44 between the adjacent triangular holes. Along the columns 16*b* and 20*b* of each steel plate, the associated triangular holes 16 and 20 have the equilateral shapes thereof provided with the same orientation and are separated from the adjacent triangular holes in the column by the generally straight webs 42 and 46.

Referring to FIG. 2, the outer steel plate 14 is provided with round mounting holes 48 that are positioned generally along the webs 42 that separate one of the rows 16*a* of triangular holes 16 from an adjacent row 16*a*. Each round mounting hole 48 is located in alignement with the triangular holes of one column 16*b* as well as being in alignment with the webs 42 that separate adjacent rows 16*a*.

As illustrated in FIG. 3, the inner steel plate 18 has round mounting holes 50 aligned along associated rows 20*a* of the triangular holes 20. These round mounting holes 50 are also aligned along associated columns 20*b*.

As shown in FIG. 5, the bolt 32 of each connector 26 extends through the round mounting holes 48 and 50 of the outer and inner perforated steel plates 14 and 18 as well as through a bushing 52 in a round mounting holes 54 of the aluminum backing plate 28 to provide the assembly as previously described. The offset hole relationship shown in FIG. 4 is provided by the combination of the location of the round mounting holes 48 of the outer plate 14 as shown in FIG. 2 in alignment with the webs 42 between the adjacent rows 16*a*, the location of the mounting holes 50 of the inner steel plate 18 in alignment with the rows 20*a*, and rotation of the outer steel plate 14 180° from the position shown in FIG. 2 with respect to the inner steel plate 18 shown in FIG. 3. This offset relationship of the hole patterns prevents straight line penetration of any projectile of any significant size through both steel plates.

In one preferred embodiment of the armor plate module 10, the outer steel plate 14 has a thickness of about $\frac{3}{8}$ of an inch and the inner steel plate 18 has a thickness of about $\frac{1}{4}$ of an inch while the first filler 22 has a thickness of about 1 inch and the second filler 24 has a thickness of about 5 to 7 inches. Both the outer and inner steel plates 14 and 18 have their equilateral triangular holes provided with the same size whose sides when extended at the rounded vertices thereof have a length with the intersecting adjacent sides of about 0.6495 inch such that the maximum circular shape that can pass through each hole has a diameter of $\frac{3}{8}$ of an inch. The center of the holes are uniformly spaced along the rows 16*a* and 20*a* by a distance of 0.5540 of an inch, while the centers of the holes are uniformly spaced along the columns 16*b* and 20*b* by a distance of 0.6945 of an inch. The webs 40 and 44 between the triangular holes along each row 16*a* (FIG. 2) and 20*a* (FIG. 3) have a width of about 0.1985 inches. Between the adjacent rows 16*a* shown in FIG. 2 and and the adjacent rows 20*a* shown in FIG. 3, the sides of the triangular holes 16 and 20 are spaced from each other by about 0.1320 of an inch with a somewhat greater spacing being provided between each side and the adjacent hole apex due to its rounding. The mounting holes 48 and 50 of each steel plate are spaced from each other by seven rows from each other such that their centers are spaced by about 4.8615 inches along the length of each column. Furthermore, the mounting holes 48 and 50 are spaced from each other by ten columns such that their centers are located about 5.54 inches from each other along each row.

As is hereinafter more fully described, each of the steel plates 14 and 18 previously described is heat treated in accordance with the method of the present invention to provide carbonitride surfaces and a tough, ductile core. The carbonitride surfaces have a hardness of at least 66 on the Rockwell C scale to prevent surface penetration, while the tough, ductile core which is softer than the carbonitride surfaces prevents brittle fracture of the steel plate. More preferably, the carbonitride surfaces have a surface hardness of at least 67 on the Rockwell C scale to provide greater resistance to penetration.

It is possible to manufacture the plate armor from steel plates of the rolled homogenous type. With rolled homogenous armor, the core hardness is in the range of about 45 to 50 on the Rockwell C scale. Many types of rolled homogenous armor are available for use and have the general composition shown by the following Table I.

TABLE I

| Element | | Maximum range percent | Maximum limit percent |
|---|---|---|---|
| Carbon | | 0.10 | 0.28 |
| Manganese: | Up to 1.00% incl. | 0.30 | — |
| | Over 1.00% | 0.40 | — |
| Phosphorus | | — | 0.025 |
| Sulfur | | — | 0.025 |
| Silicon: | Up to 0.60% incl. | 0.20 | — |
| | Over 0.60% to 1.00% incl. | 0.30 | — |
| | Over 1.00% | 0.40 | — |
| Nickel | | 0.50 | — |
| Chromium: | Up to 1.25% incl. | 0.30 | — |
| | Over 1.25% | 0.40 | — |
| Molybdenum: | Up to 0.20% incl. | 0.07 | — |
| | Over 0.20% | 0.15 | — |
| Vanadium: | | 0.15 | — |

It is also possible to manufacture the plate armor from steel plate that is made from high-hard armor. With high-hard armor, the steel plate will have a core hardness in the range of about 52 to 54 on the Rockwell C scale. High-hard armor is also commercially available with the general composition as shown by the following Table II.

TABLE II

| Element | | Maximum range percent | Maximum limit percent |
|---|---|---|---|
| Carbon | | 0.10 | 0.32 |
| Manganese: | Up to 1.00% incl. | 0.30 | — |
| | Over 1.00% | 0.40 | — |
| Phosphorus | | — | 0.025 |
| Sulfur | | — | 0.025 |
| Silicon: | Up to 0.60 incl. | 0.20 | — |
| | Over 0.60% to 1.00% incl. | 0.30 | — |
| Nickel | | 0.50 | — |
| Chromium: | Up to 1.25% incl. | 0.30 | — |
| | Over 1.25% | 0.40 | — |
| Molybdenum: | Up to 0.20% incl. | 0.07 | — |
| | Over 0.20% | 0.15 | — |
| Vanadium: | | 0.15 | — |

The thickness of steel plate utilized to provide the case hardened plate armor is in the range of about 0.15 to 0.5 of an inch. Also, the thickness of the carbonitride surfaces do not have to be particularly deep, about 0.016 of an inch is sufficient to provide the requisite surface hardness that is supported by the tougher, more ductile core. While carbonitride surfaces have previously been utilized to provide greater resistance to wear, such as on rotary shaft wear surfaces, such hardening has never been previously utilized to provide case-hardened plate armor in the manner herein disclosed.

As disclosed, the plate armor has holes formed therethrough prior to the heat treating. However, it should be understood that it is also possible to utilize the carbonitride heat treating process of this invention with imperforate steel plates. When holes are formed in the steel plate, it is preferable for the holes to have the same size and shape as each other arranged in the type of repeating pattern previously described. Also, the webs between the holes preferably have a width in the range of about 0.1 to 0.25 of an inch to provide best results.

Figure 6:
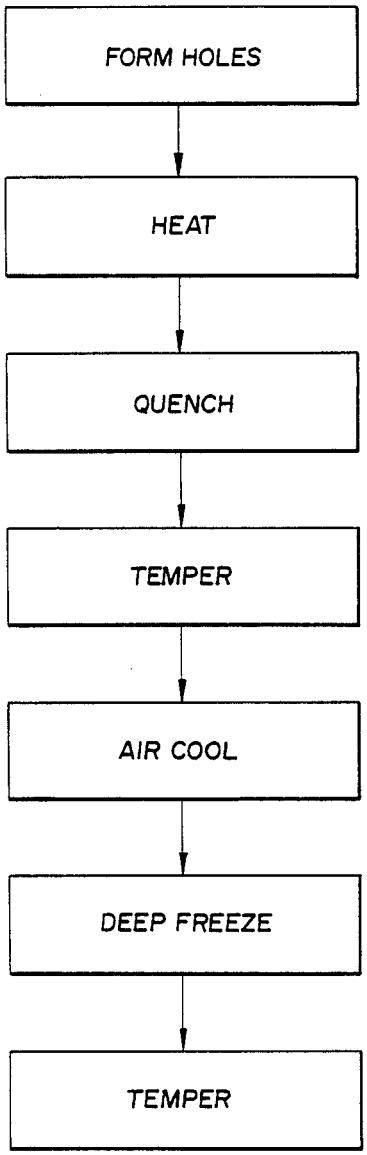
FIG. 6 is a schematic view that illustrates processing used to provide the steel plates of the armor plate module.

The process for performing the case hardening of the steel plate can be best understood by reference to FIG. 6. If holes are to be utilized, these holes are initially formed prior to the heat treating. While it is preferable to form the holes by a punching operation, it is also possible to provide the holes by drilling, laser cutting, electron beam cutting or any other type of process capable of accurately providing holes through the steel plate.

After the formation of any desired holes, the steel plate is heated in an atmosphere of nitrogen and carbon to provide the carbonitride surfaces. Cracked ammonia and methane are preferably utilized to readily provide the atmosphere of nitrogen and carbon. The heating in this atmosphere is performed for about 1 to 3 hours at a temperature in the range of about 1300° F. to 1550° F., with the time being more critical than the temperature in controlling the degree of hardening achieved.

After the initial heating, the steel plate is quenched to form martensite. This quencing is preferably performed with oil to prevent distortion and to also insure that all of the austenite is changed to martensite.

After the quench, the steel plate is tempered to change the martensite to tempered martensite and ferrite. This tempering of the steel plate is preferbly performed for ½ to 2 hours at a temperature in the range of 275° F. to 325° F. in order to effect the change of the martensite to the tempered martensite and ferrite.

An air cool of the steel plate after the initial tempering precedes a deep freeze step to permit cooling to the embient without any expenditure of energy. The deep freeze step is then performed to change any retained austensite to martensite. This deep freezing is preferably performed for 1 to 3 hours at a temperature in the range of −50° F. to −150° F..

After the deep freeze step, the steel plate is again tempered to change any additional martensite resulting from the deep freezing to tempered martensite and ferrite. This additional tempering like the initial tempering is preferably performed for ½ to 2 hours at a temperature in the range of 275° F. to 325° F..

The carbonitride processing described above provides hard carbonitride surfaces and a softer but more ductile core such that the resultant steel plate is resistant to fracture as described above.

While the best mode for carrying out the invention has been described in detail, those familiar with the art to which this invention relates will recognize various alternative designs, embodiments, and ways for carrying out the invention as defined by the following claims.

What is claimed is:

1. Case-hardened plate armor comprising: a steel plate having holes formed therethrough prior to a subsequent heat treatment that provides carbonitride surfaces and a tough, ductile core; said carbonitride surfaces having a hardness after the heat treatment of at least 67 on the Rockwell C scale to prevent surface penetration; and the steel plate being selected from the group consisting of:

(a) rolled homogenous armor and having a core hardness after the heat treatment in the range of 45 to 50 on the Rockwell C scale to prevent brittle fracture of the steel plate, and (b) high-hard armor and having a core hardness after the heat treatment in the range of 52 to 54 on the Rockwell C scale to prevent brittle fracture of the steel plate.

2. Plate armor as in claim 1 wherein the steel plate has a thickness in the range of about 0.15 to 0.5 of an inch.

3. Plate armor as in claim 1 wherein holes have the same size and shape as each other and are arranged in a repeating pattern.

4. Case-hardened plate armor comprising: a steel plate of rolled homogenous armor that is heat treated to provide carbonitride surfaces and a tough, ductile core; said carbonitride surfaces having a hardness after the heat treatment of at least 67 on the Rockwell C scale to prevent surface penetration; the tough, ductile core having a hardness after the heat treatment in the range of about 45 to 50 on the Rockwell C scale to prevent brittle fracture of the steel plate; and the steel plate having holes of the same size and shape formed therethrough in a repeating pattern prior to the case-hardening of the surfaces and the core.

5. Case-hardened plate armor comprising: a steel plate of high-hard armor that is heat treated to provide carbonitride surfaces and a tough, ductile core; said carbonitride surfaces having a hardness of at least 67 on the Rockwell C scale to prevent surface penetration; the tough, ductile core having a hardness in the range of about 52 to 54 on the Rockwell C scale to prevent brittle fracture of the plate; and the steel plate having holes of the same size and shape formed therethrough in a repeating pattern prior to the case-hardening of the surfaces and the core.

6. A method for case-hardening a steel plate to provide plate armor, said method comprising:

a) heating the steel plate in an atmosphere of nitrogen and carbon for 1 to 3 hours at a temperature in the range of 1300° F. to 1550° F.;

(b) quenching the heated steel plate;

(c) initially tempering the quenched steel plate for ½ to 2 hours at a temperature in the range of 275° F. to 325° F.;

(d) deep freezing the tempered steel plate for 1 to 3 hours at a temperature in the range of −50° F. to −150° F.; and (e) subsequently again tempering the steel plate after the deep freezing to provide hard carbonitride surfaces and a softer but tougher and more ductile core, said subsequent tempering being performed for ½ to 2 hours at a temperature in the range of 275° F. to 325° F..

7. A method as in claim 6 wherein the steel plate is heated in an atmosphere of cracked ammonia and methane which provide the nitrogen and carbon.

8. A method as in claim 6 wherein the quenching is performed by an oil quench.

9. A method as in claim 6 wherein the initially tempered steel plate is air cooled to ambient temperature before the deep freezing.

10. A method as in any one of claims 6, wherein the steel plate is formed with holes prior to the initial heating in the atmosphere of nitrogen and carbon.

11. A method for case-hardening a steel plate to provide plate armor, said method comprising:

(a) heating the steel plate in an atmosphere of cracked ammonia and methane for 1 to 3 hours at a temperature in the range of 1300° F. to 1550° F.;

(b) oil quenching the heated steel plate;

(c) tempering the quenched steel plate for ½ to 2 hours at a temperature in the range of 275° F. to 325° F.;

(d) deep freezing the tempered steel plate for 1 to 3 hours at a temperature in the range of −50° F. to −150° F.; and e) subsequently again tempering the steel plate after the deep freezing for ½ to 2 hours at a temperature in the range of 275° F. to 325° F. to provide hard carbonitride surfaces and a softer but tougher and more ductile core.

12. A method for making a case-hardened, webbed steel plate, the method comprising:

(a) forming holes in a steel plate to provide webs between the holes;

(b) heating the webbed steel plate in an atmosphere of cracked ammonia and methane for 1 to 3 hours at a temperature in the range of 1300° F. to 1550° F.;

(c) oil quenching the heated steel plate;

(d) tempering the quenched steel plate for ½ to 2 hours at a temperature in the range of 275° F. to 325° F.;

(e) deep freezing the tempered steel plate for 1 to 3 hours at a temperature in the range of −50° F. to −150° F.; and (f) subsequently again tempering the steel plate after the deep freezing for ½ to 2 hours at a temperature in the range of 275° F. to 325° F. to provide the webbed steel plate with hard carbonitride surfaces and a softer but tougher and more ductile core.

* * * * *

UNITED STATES PATENT AND TRADEMARK OFFICE

CERTIFICATE OF CORRECTION

PATENT NO. : 4,857,119

DATED : August 15, 1989

INVENTOR(S) : David A. Karst, et al

It is certified that error appears in the above-identified patent and that said Letters Patent is hereby corrected as shown below:

Col. 4, line 10, "tht" should be --that--.

Col. 4, line 23, "holes" should be --holds--.

Col. 4, line 52, "punchign" should be --punching--.

Col. 5, lines 7 and 8, "alignement" should be --alignment--.

Col. 7, line 42, "embient" should be --ambient--.

Col. 8, line 66, claim 10, insert --7, 8 or 9-- after "6,".

Signed and Sealed this

Fourth Day of June, 1991

*Attest:*

HARRY F. MANBECK, JR.

*Attesting Officer*

*Commissioner of Patents and Trademarks*